US005857441A

United States Patent [19]

Yonezawa et al.

[11] Patent Number: 5,857,441

[45] Date of Patent: Jan. 12, 1999

[54] VALVE MECHANISM LUBRICATOR OF ENGINE

[75] Inventors: Makoto Yonezawa; Hiroaki Kojima; Yasutake Ryu; Takashi Suzuki, all of Wako, Japan

[73] Assignee: Honda Giken Kogyo Kabushiki Kaisha, Tokyo, Japan

[21] Appl. No.: 957,926

[22] Filed: Oct. 27, 1997

[30] Foreign Application Priority Data

Oct. 29, 1996 [JP] Japan ..... 8-286937

[51] Int. Cl.[6] ..... F01M 1/00

[52] U.S. Cl. ..... 123/196 R; 123/90.33

[58] Field of Search ..... 123/196 R, 90.33

[56] References Cited

U.S. PATENT DOCUMENTS

| | | | |
|---|---|---|---|
| 2,620,897 | 12/1952 | Simpkin . | |
| 4,766,859 | 8/1988 | Miyaki et al. . | |
| 4,930,462 | 6/1990 | Kamata | 123/196 R |
| 4,955,335 | 9/1990 | Jingu et al. | 123/90.33 |
| 5,092,292 | 3/1992 | Iguchi et al. | 123/196 R |
| 5,143,033 | 9/1992 | Catterson et al. | 123/196 R |
| 5,588,405 | 12/1996 | Sawa et al. | 123/90.33 |

FOREIGN PATENT DOCUMENTS

| | | |
|---|---|---|
| 0 279 445 A2 | 2/1988 | European Pat. Off. . |
| 0 620 361 A1 | 12/1993 | European Pat. Off. . |

*Primary Examiner*—John T. Kwon

*Attorney, Agent, or Firm*—Armstrong, Westerman, Hattori, McLeland & Naughton

[57] ABSTRACT

A rotary disc of a speed-regulating centrifugal governor driven by a crank shaft is rotatably fitted to a crank case of an engine. While part of the rotary disc is immersed in lubricating oil stored in the crank case, the rotary disc is disposed adjacent to a timing gear and impeller blades project from the outer peripheral face of the rotary disc so as to form an impeller. Further, guide walls for guiding oil splashed by the rotation of the impeller to the timing gear are integrally formed with the inside wall of the crank case, so that the timing gear of a valve mechanism can be effectively lubricated with the splashed oil.

3 Claims, 4 Drawing Sheets

VALVE MECHANISM LUBRICATOR OF ENGINE

BACKGROUND OF THE INVENTION

1. Field of the Invention

The present invention relates to a valve mechanism lubricator adapted for use in splash lubrication of a timing gear in an engine in which a crank shaft supported by a crank case is coupled via the timing gear to a valve cam shaft supported by a cylinder head.

2. Description of the Related Art

In order to lubricate the interior of an engine, heretofore known practice is to form, in the large end portion of a connecting rod coupled to a crank shaft, an oil dipper for splashing the lubricating oil stored in an oil storage chamber located at a lower portion of a crank case.

In such a lubricator, however, the oil splashed by the oil dipper formed on the connecting rod may not be supplied sufficiently to a timing gear because the connecting rod of the engine and the timing gear are generally spaced significantly apart from each other in the axial direction of the crank shaft.

SUMMARY OF THE INVENTION

An object of the present invention made in view of the foregoing problems is to provide a valve mechanism lubricator for an engine, which lubricator is not only simple in structure but also capable of effective splash lubrication of a timing gear.

In order to accomplish the above object, a valve mechanism lubricator according to the present invention has a first feature that in an engine wherein a crank shaft supported by a crank case is coupled via a timing gear to a valve cam shaft supported by a cylinder head, the lower portion of the crank case is used as an oil storage chamber; an impeller, which is driven by the crank shaft to splash lubricating oil stored in the oil storage chamber, is disposed adjacent the timing gear; and guide walls for use in guiding the oil splashed by the impeller to the timing gear are formed along the inside wall of the crank case.

With this arrangement having such a feature, the lubricator is not only simple in structure, but also capable of splash lubrication of the timing gear effectively and satisfactorily.

In addition to the arrangement as set forth above, a valve mechanism lubricator, according to the present invention, has a second feature that a plurality of impeller blades are projected from the outer peripheral face of the rotary disc of a speed regulating centrifugal governor, which is driven by the crank shaft, so as to form an impeller.

With this feature, an impeller dedicated for use only in splashing oil can be omitted, so that the lubricator is further simplified in structure.

DESCRIPTION OF THE PREFERRED EMBODIMENTS

Embodiments of the present invention will be described with reference to the accompanying drawings.

Figure 1:
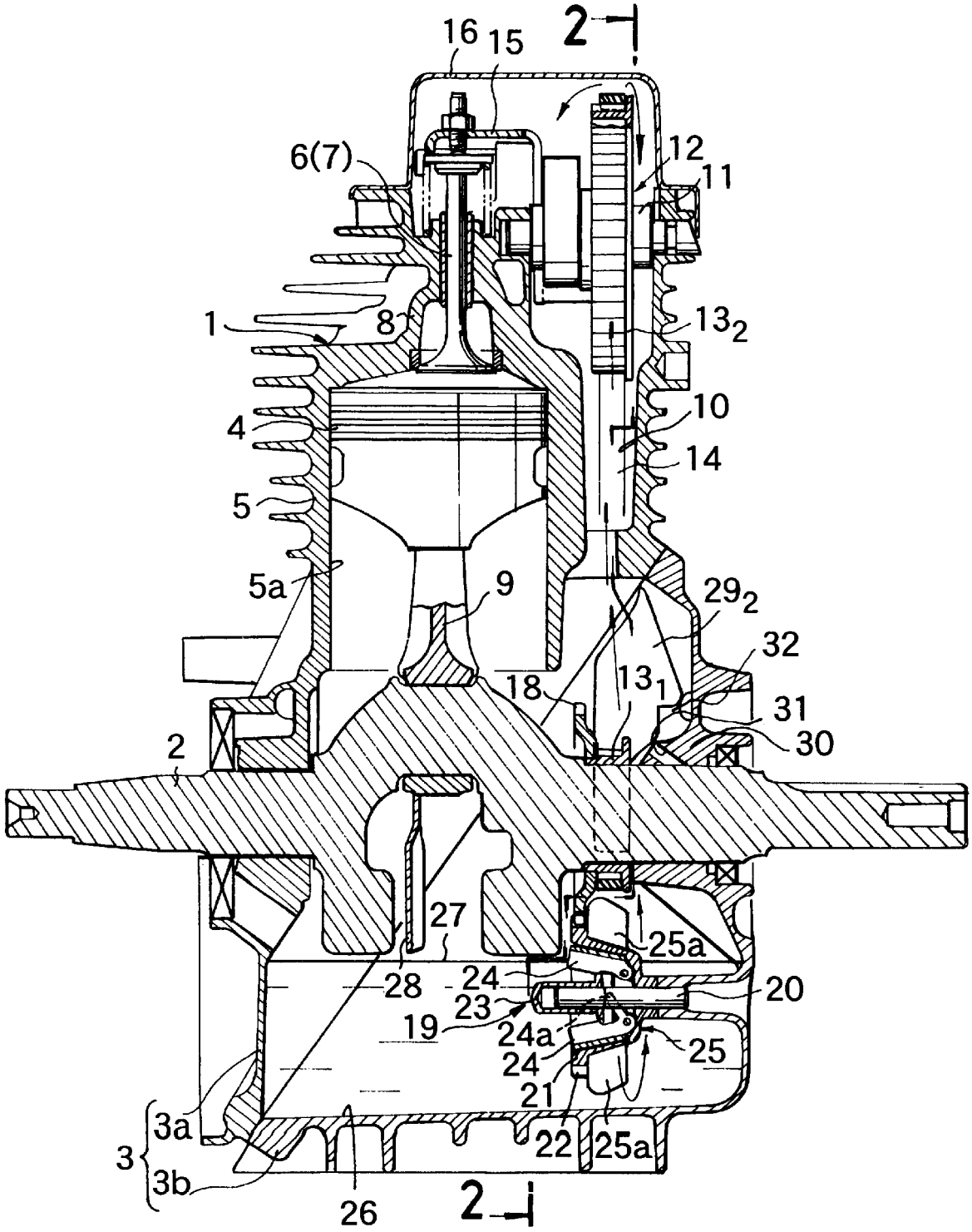
FIG. 1 is a vertical sectional side view of a horizontal type engine of a first embodiment of the present invention.

First, a description will be given of a case in which the present invention is applied to a horizontal type engine with reference to FIGS. 1 and 2.

An engine body 1 comprises a crank case 3 for supporting a crank shaft 2 installed horizontally, a cylinder block 5 having a cylinder bore 5a into which a piston 4 is fitted, and a cylinder head 8 for supporting an inlet/exhaust valve 6 (7), a connecting rod 9 used to couple the crank shaft 2 and the piston 4. The crank case 3 is divided into an upper case body 3*a* and a lower case body 3*b* along the diagonal line of the crank case 3 obliquely crossing the axial line of the crank shaft 2, and the three elements consisting of the upper case body 3*a*, the cylinder block 5 and the cylinder head 8 are integrally molded. Thus, the engine body 1 is comprised of the two described component parts. The upper and lower case bodies 3*a*, 3*b* are mutuallydetachably coupled by bolts.

A generally flat valve gear chamber 10, which is adjacent to the cylinder bore 5*a*, is formed on one side portion of the cylinder block 5, and a timing gear 12, for use in coupling the crank shaft 2 and a valve cam shaft 11 supported by the cylinder head 8, is disposed in the valve gear chamber 10. The timing gear 12 is comprised of a toothed driving pulley $\mathbf{13}_1$ firmly secured to the crank shaft 2, a toothed driven pulley $\mathbf{13}_2$ firmly secured to the valve cam shaft 11 and a toothed belt 14 wound on both the pulleys $\mathbf{13}_1$, $\mathbf{13}_2$, so that the speed transmitted to the valve cam shaft 11 is reduced to a half of the number of rotations of the crank shaft 2. The valve cam shaft 11 is adapted, when it rotates, to drive the inlet/exhaust valve 6 (7) to open and close via a rocker arm 15. The portion above the timing gear 12 and the rocker arm 15 is covered by a head cover 16 which is coupled to the surface of the cylinder head 8 by bolts. A stepped portion 17, directed up and facing the descending side of the belt 14, is formed in the cylinder block 5 between the cylinder head 8 and the head cover 16, the stepped portion 17, as best shown in FIG. 2, having a recessed portion.

A governor driving gear 18 is firmly secured to the crank shaft 2 adjacent the driving pulley 13, and a speed-regulating centrifugal governor 19, driven thereby, is disposed in the lower portion of the crank case 3. The centrifugal governor 19 is provided with a rotary disc 21 which is firmly secured to the side wall of the crank case 3 and supported by a support shaft 20 extending in parallel to the crank shaft 2. A driven gear 22, which meshes with the governor driving gear 18, is formed on the outer periphery of the rotary disc 21. The centrifugal governor 19 includes the rotary disc 21, a cylindrical slider 23 into which the support shaft 20 is slidably fitted, and a plurality of pendulum-type centrifugal weights 24, which are swingably and pivotally supported by the rotary disc 21 with the slider 23 held therebetween. Each centrifugal weight 24 is equipped with an operating arm 24*a* for sliding the slider 23 in one direction when the centrifugal weight 24 is swung outwardly in the radial direction due to the centrifugal force. The slider 23 that is slid in the one direction operates to close a throttle valve of the inlet system via a link mechanism (not shown), as is conventional, and controls the number of revolutions of the engine to a predetermined value.

The rotary disc 21 is provided with an impeller 25 having a plurality of impeller blades 25*a* projecting radially from its outer periphery adjacent the driving pulley $\mathbf{13}_1$.

The lower portion of the crank case 3 is formed into an oil storage chamber 26 and the quantity of lubricating oil 27 stored in the chamber 26 is set to maintain an oil level below the driving pulley 13, so as not to immerse the crank shaft 2 and the driving pulley $\mathbf{13}_1$ in the lubricating oil but, instead, to immerse a major part of the impeller 25 in the lubricating oil. While motive power loss attributed to stirring of the lubricating oil 27 by means of the crank shaft 2 and the timing gear 12 is avoided, the generation of a required quantity of splashing oil is made possible by the impeller 25.

An oil dipper 28 for splashing the lubricating oil 27 through the movement of the connecting rod 9 is formed in the large end portion of the connecting rod 9.

Figure 2:
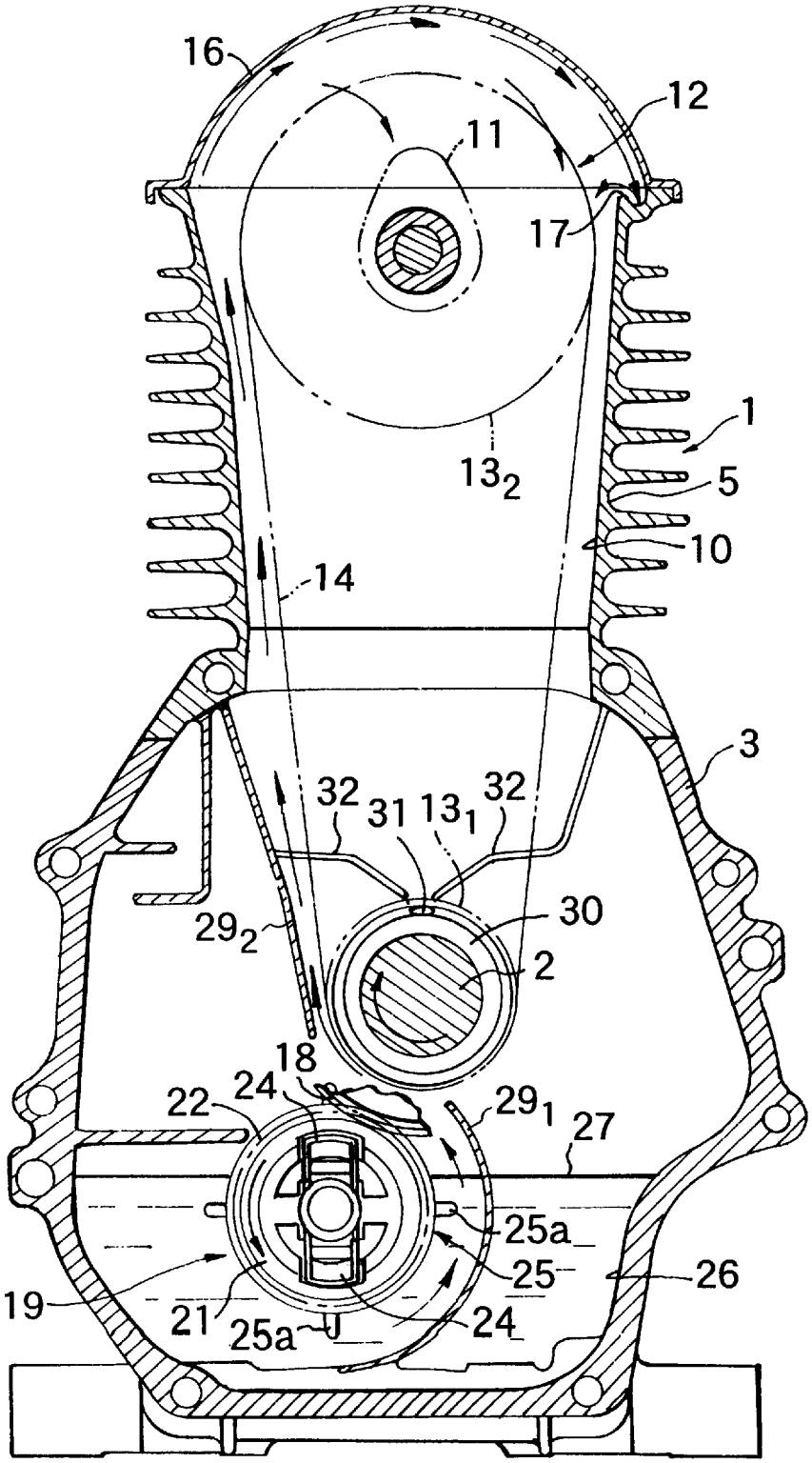
FIG. 2 is a vertical sectional view taken on line 2—2 of FIG. 1.

An arcuate first guide wall $\mathbf{29}_1$ for enclosing the upper portion of the rotation path of the blades 25*a* of the impeller 25 and a second guide wall $\mathbf{29}_2$ for enclosing the rising path of the belt 14 from the driving pulley $\mathbf{13}_1$ to the valve gear chamber 10 are integrally formed with the inside wall of the crank case 3; that is, with the inside wall of the lower case body 3*b*, as illustrated in FIG. 2.

The crank case 3 supporting the crank shaft 2 is provided, on the driving pulley $\mathbf{13}_1$ side thereof, with a bearing boss 30 having a wall enclosing the crank shaft 2. An oil gallery 31 is bored in the upper wall of the bearing boss 30 and extends to the inner face thereof, and a pair of oil gathering walls 32, extending upward in the form of V from the bearing boss 30 with the oil gallery 31 held therebetween, are integrally formed with the inside wall of the crank case 3.

The function of this embodiment of the invention is as follows. The timing gear 12 and the centrifugal governor 19 are simultaneously driven by the crank shaft 2 during the operation of the engine. When the centrifugal governor 19 is driven, the rotary disc 21, and thus the impeller 25, starts stirring the lubricating oil 27 in the oil storage chamber 26 and causes the lubricating oil 27 to splash upward. The splashing oil is first guided by the first guide wall $\mathbf{29}_1$ toward the driving pulley $\mathbf{13}_1$ of the timing gear 12 and the second guide wall $\mathbf{29}_2$, and, subsequently, the splashing oil is guided by the second guide wall $\mathbf{29}_2$ to the valve gear chamber 10, so that the timing gear 12 can effectively be lubricated. The lubricating oil used to lubricate the timing gear 12 is splashed and used to lubricate the valve mechanism elements, such as the cam shaft 11, and the rocker arm 15. Particularly, the oil splashed from the driven pulley $\mathbf{13}_2$ of the timing gear 12 hits against the upwardly-directed stepped portion 17 between the cylinder head 8 and the head cover 16 and is then splashed around, thus lubricating the valve mechanism elements satisfactorily. The lubricating oil then flows down along the inside wall of the valve gear chamber 10 after the aforementioned lubrication and part of the oil is guided by the oil gathering walls 32 into the oil gallery 31 of the bearing boss 30 and used to lubricate its inner peripheral face, while the other part of the oil is returned to the oil storage chamber 26.

While the connecting rod 9 is moving up and down and oscillating, the lubricating oil 27 in the oil storage chamber 26 is stirred and splashed by the oil dipper 28, whereby the crank shaft 2, the connecting rod 9, the piston 4, and the like, are lubricated by the splashing oil.

It should be noted that, as a result of the disclosed arrangement, the provision of a special impeller 25 for splashing lubricating oil is not required since the impeller 25 for splashing the oil for lubricating the timing gear 12 is formed by utilizing the rotary disc 21 of the speed-regulating centrifugal governor 19, and its structure can thus be simplified. Since the impeller 25 is disposed closely adjacent the driving pulley $\mathbf{13}_1$, the splashing oil can effectively be supplied to the timing gear 12 in cooperation with the guiding functions of the first and second guide walls $\mathbf{29}_1$, $\mathbf{29}_2$.

Figure 3:
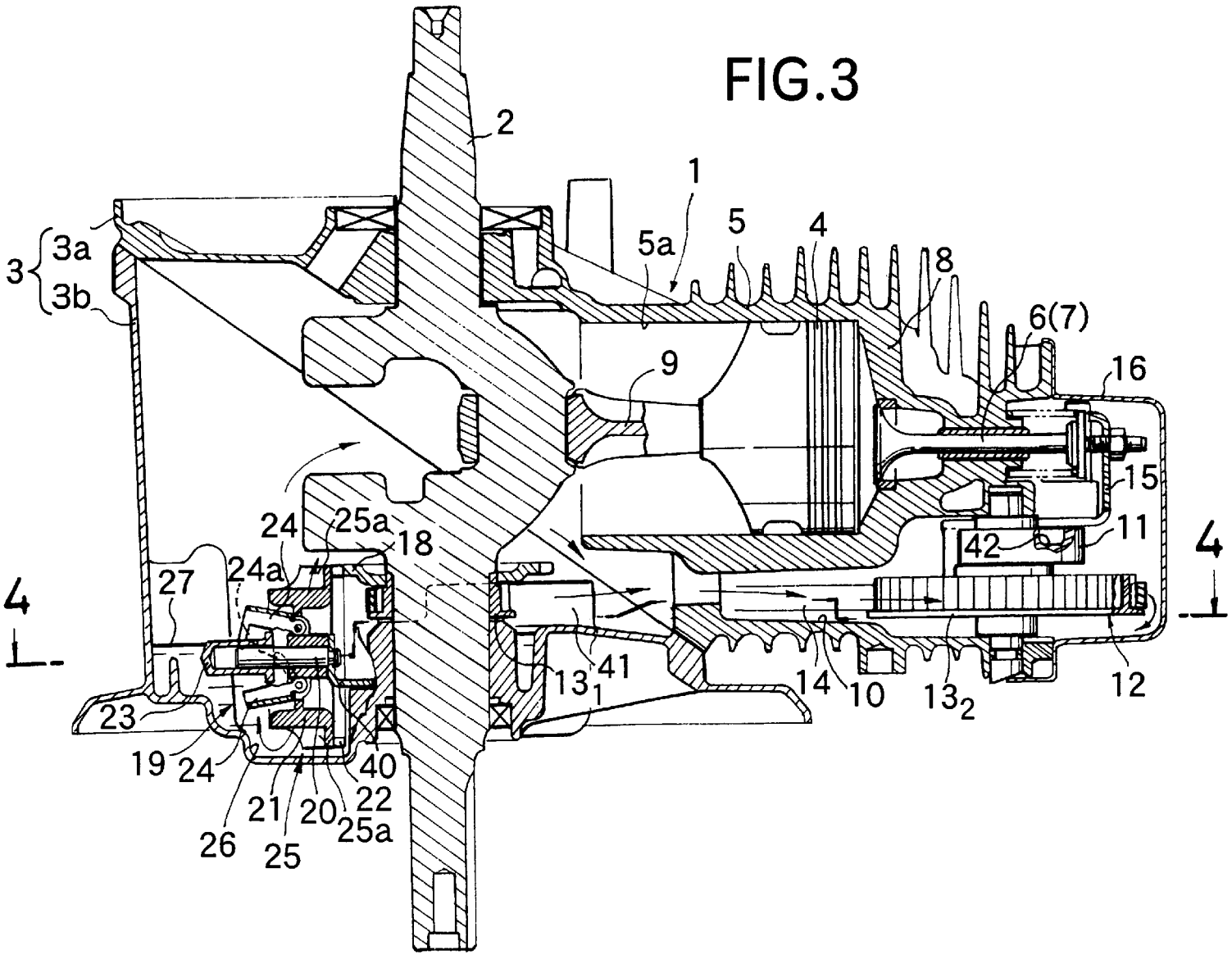
FIG. 3 is a vertical sectional side view of a vertical type engine of a second embodiment of the present invention.
Figure 4:
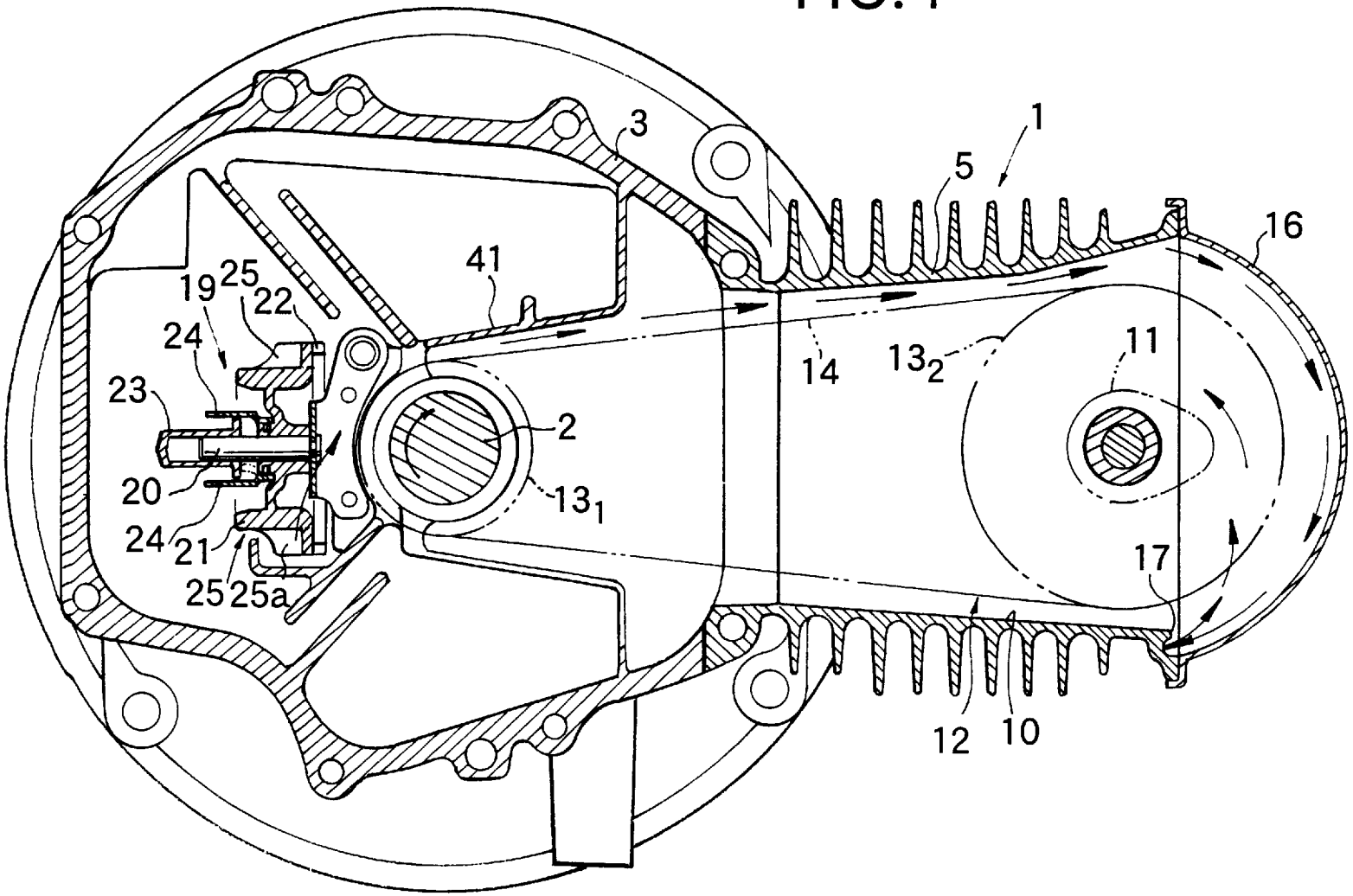
FIG. 4 is a sectional view taken on line 4—4 of FIG. 3.

A description will next be given of the application of the present invention to a vertical type engine of a second embodiment thereof with reference to FIGS. 3 and 4.

An engine body 1 is provided with a crank shaft 2 directed vertically and with a valve gear chamber 10 placed on the lower side thereof. An oil storage chamber 26 is formed in a lower case body 3*b* of a crank case 3, which is deeper than the valve gear chamber 10, and the quantity of lubricating oil 27 to be stored therein is limited to the extent that a timing gear 12 is not immersed in the lubricating oil under the surface thereof.

A support shaft 20 of a speed-regulating centrifugal governor 19 is horizontally and firmly secured to a bracket 40 which is firmly secured to the inside wall of the lower case body 3*b*. A driven gear 22 meshing with a governor driving, gear 18 firmly secured to the crank shaft 2 is formed on the edge face of a rotary disc 21 rotatably supported by the support shaft 20. As in the preceding embodiment of the invention, the rotary disc 21 is provided with an impeller 25 having a plurality of impeller blades 25*a* projecting from its outer periphery and the major part of the impeller 25 is immersed in the lubricating oil 27.

A guide wall 41 enclosing the path of a belt 14 moved toward a driven pulley $\mathbf{13}_2$ from a driving pulley $\mathbf{13}_1$ through a valve gear chamber 10 is integrally formed with the inside wall of the crank case 3. A recessed portion 42 for use as an oil reservoir is formed in the upper edge face of a valve cam shaft 11.

As the rest is substantially similar in arrangement to the preceding embodiment of the invention, like reference characters are given to like component parts and the description thereof will be omitted.

Thus, even in this embodiment of the invention, the lubricating oil in the oil storage chamber 26 is splashed as the impeller 25 rotates during the rotation of the crank shaft 2 and the splashed oil is guided by the adjacent guide wall 41 toward the valve gear chamber 10 and used to lubricate the timing gear 12 and other elements of the valve mechanism. Oil droplets from above are stored in the recessed portion 42 in the upper edge face of the valve cam shaft 11 after the engine is stopped. When the engine is restarted oil is discharged from the recessed portion 42 and used to lubricate the surrounding elements of the valve mechanism. Therefore, lack of oil in the valve mechanism is prevented, particularly when the engine is started after the suspension of operation for hours.

The present invention is not limited to the embodiments thereof but may be modified in various manners so far as change is concerned without departing from the scope and spirit of the invention. For example, the timing gear 12 may be comprised of a chain or a gear.

What is claimed is:

1. In an engine having a valve mechanism including at least one valve, and a crank shaft supported by a crank case is coupled via a timing gear to a valve cam shaft supported by a cylinder head, a valve mechanism lubricator for such an engine, comprising:

a lower portion of the crank case defining an oil storage chamber; an impeller driven by the crank shaft to splash lubricating oil stored in the oil storage chamber disposed adjacent the timing gear; and guide walls formed along the inside wall of the crank case and operative to guide the oil splashed by the impeller to the timing gear.

2. A valve mechanism lubricator for an engine as claimed in claim 1, wherein said impeller is defined by a speed-regulating centrifugal governor driven by the crank shaft and having a rotary disc provided with a plurality of impeller blades projected from an outer peripheral face thereof.

3. A valve mechanism lubricator for an engine as claimed in either claim 1 or claim 2, wherein said crank shaft is supported by a bearing boss formed in said crank case; said bearing boss being bored in an upper wall thereof to form an oil gallery extending to an inner face of said bearing boss upper wall; and a pair of oil gathering walls integrally formed with the crank case and extending upward in the form of a V from the bearing boss, with the oil gallery disposed therebetween.

* * * * *